US008948651B2

(12) United States Patent
Lee

(10) Patent No.: US 8,948,651 B2
(45) Date of Patent: Feb. 3, 2015

(54) IMAGE FORMING APPARATUS

(71) Applicant: Samsung Electronics Co., Ltd., Suwon-si, Gyeonggi-do (KR)

(72) Inventor: Han Jun Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 65 days.

(21) Appl. No.: 13/742,019

(22) Filed: Jan. 15, 2013

(65) Prior Publication Data

US 2013/0183062 A1 Jul. 18, 2013

(30) Foreign Application Priority Data

Jan. 16, 2012 (KR) ..... 10-2012-0004655

(51) Int. Cl.

| | |
|---|---|
| ***G03G 15/02*** | (2006.01) |
| ***G03G 15/08*** | (2006.01) |
| ***G03G 21/16*** | (2006.01) |
| *G03G 15/16* | (2006.01) |

(52) U.S. Cl.

CPC ..... *G03G 15/0832* (2013.01); *G03G 21/1633* (2013.01); *G03G 21/1647* (2013.01); *G03G 21/1666* (2013.01); *G03G 21/1671* (2013.01); *G03G 21/1676* (2013.01)

USPC ..... 399/110; 399/111

(58) Field of Classification Search

CPC ..... G03G 21/18; G03G 21/1817; G03G 21/1821; G03G 21/1825; G03G 21/1828; G03G 21/1832

USPC ..... 399/110, 111

See application file for complete search history.

(56) References Cited

U.S. PATENT DOCUMENTS

| | | | | |
|---|---|---|---|---|
| 7,447,467 | B2 * | 11/2008 | Kamimura et al. | 399/119 |
| 2004/0096240 | A1 * | 5/2004 | Kim | 399/222 |
| 2005/0185984 | A1 * | 8/2005 | Arimitsu et al. | 399/114 |
| 2006/0228132 | A1 * | 10/2006 | Chadani et al. | 399/111 |

(Continued)

FOREIGN PATENT DOCUMENTS

| | | |
|---|---|---|
| EP | 0889378 A2 | 1/1999 |
| EP | 1939695 A2 | 7/2008 |
| JP | 11-109833 | 4/1999 |

OTHER PUBLICATIONS

Extended European Search Report issued Jul. 11, 2013 in corresponding European Application No. 13151372.3.

*Primary Examiner* — Clayton E LaBalle
*Assistant Examiner* — Ruifeng Pu
(74) *Attorney, Agent, or Firm* — Staas & Halsey LLP

(57) ABSTRACT

An image forming apparatus having an improved structure of simply executing contact or separation between developing rollers and photoconductors is provided. The image forming apparatus includes a cover opening and closing a side of a main body, a photoconductor unit including a photoconductor, a laser scanning unit irradiating the photoconductor to form an electrostatic latent image and including a light source generating light and an optical window transmitting the light generated from the light source, a developing unit supplying a developer to the photoconductor and including a developing roller contacting or separated from the photoconductor, and a shutter unit operable in connection with the cover, opening the optical window when the cover closes the side of the main body, and closing the optical window when the cover opens the side of the main body.

27 Claims, 7 Drawing Sheets

(56) References Cited

U.S. PATENT DOCUMENTS

2008/0317501 A1 12/2008 Mase et al.
2009/0175649 A1 7/2009 Seorl et al.
2010/0239312 A1* 9/2010 Kikuchi et al. ..... 399/111
2011/0142489 A1* 6/2011 Yoshimura et al. ..... 399/110
2012/0183323 A1* 7/2012 Nakano et al. ..... 399/110
2014/0072334 A1* 3/2014 Itabashi ..... 399/110
2014/0105644 A1* 4/2014 Kamimura et al. ..... 399/162

* cited by examiner

IMAGE FORMING APPARATUS

CROSS-REFERENCE TO RELATED APPLICATIONS

This application is related to, and claims priority to, Korean Patent Application No. 10-2012-0004655, filed on Jan. 16, 2012 in the Korean Intellectual Property Office, the disclosure of which is incorporated herein by reference.

BACKGROUND

1. Field

Embodiments of the present invention relate to an image forming apparatus capable of executing contact and/or separation between developing rollers and photoconductors.

2. Description of the Related Art

Image forming apparatuses form an image on a printing medium according to an input signal, and correspond to a printer, a copier, a facsimile and/or a multi-function apparatus having combined functions thereof.

An electrophotographic image forming apparatus, which is a kind of image forming apparatus, includes photoconductor units including photoconductors, charging units arranged, for example, around the photoconductor units and charging the photoconductors with a designated electric potential, developing units including developing rollers, and a laser scanning unit. The laser scanning unit irradiates the photoconductors charged with the designated electric potential by the charging units to form electrostatic latent images on the surfaces of the photoconductors, and the developing units supply developers to the photoconductors on which the electrostatic latent images are formed to form visible images on the photoconductors.

In an image forming apparatus in which developers are supplied to photoconductors by contact between developing rollers and the photoconductors, the developing rollers and the photoconductors may contact each other if a printing operation is executed. The developing rollers and the photoconductors may be separated from each other so as to prevent interference between the developing rollers and the photoconductors if the developing units are replaced.

To apply pressure to the developing unit or release of pressure applied to the developing unit, a separate component, such as a lever, may be used. If plural developing units are used, levers equal in number to a number of the developing units may be required. Thus, the configuration of the image forming apparatus may become complicated and the space utility of the image forming apparatus may be lowered. Since application of pressure to plural developing units or release of pressure applied to the plural developing units may be respectively executed, the quality of an image may be lowered due to a deviation generated between the respective developing units. Thus, the convenience of the image forming apparatus to a user may be lowered.

SUMMARY

It is an aspect of the present invention to provide an image forming apparatus having an improved structure to simplify an executing contact and/or separation between developing rollers and photoconductors.

It is an aspect of the present invention to provide an image forming apparatus having an improved structure to simultaneously executing application of pressure to plural developing rollers and/or release of pressure from the plural developing units.

Additional aspects of the invention will be set forth in part in the description which follows and, in part, will be obvious from the description, or may be learned by practice of the invention.

In accordance with an aspect of the present invention, an image forming apparatus includes a main body, a cover opening and closing a side of the main body, at least one photoconductor unit arranged within the main body and including a photoconductor, a laser scanning unit irradiating light onto the photoconductor to form an electrostatic latent image, and including a light source generating light and at least one optical window transmitting the light generated from the light source, at least one developing unit supplying a developer to the photoconductor on which the electrostatic latent image is formed to form a visible image, and including a developing roller contacting or separated from the photoconductor, and a shutter unit operable in connection with the cover, opening the at least one optical window when the cover closes the side of the main body, and closing the at least one optical window when the cover opens the side of the main body, wherein the shutter unit applies pressure to the at least one developing unit to execute contact between the developing roller and the photoconductor during a process of opening the at least one optical window, and releases pressure applied to the at least one developing unit to execute separation between the developing roller and the photoconductor during a process of closing the at least one optical window.

The at least one developing unit may be rotatably combined with the at least one photoconductor unit, and the shutter unit may apply pressure to a side of the at least one developing unit to rotate the at least one developing unit and thus execute contact between the developing roller and the photoconductor.

A pressure surface of the at least one developing unit to which pressure is applied by the shutter unit, and the developing roller may be arranged at opposite positions based on the center of rotation of the at least one developing unit.

The shutter unit may include a body part provided with at least one opening transmitting light having passed through the at least one optical window, and a plurality of pressure parts combined with both sides of the body part, each of the plurality of pressure parts may include a pressure member contacting the at least one developing unit to apply pressure to the at least one developing unit, and an elastic member elastically supporting the pressure member.

The at least one developing unit may be rotatably combined with the at least one photoconductor unit, and the developing roller and the pressure member may be arranged at positions above and below the center of rotation of the at least one developing unit.

The pressure member may apply pressure to the lower end of the at least one developing unit to rotate the at least one developing unit when the cover closes the side of the main body, so that the developing roller arranged at the position above the center of rotation of the at least one developing unit contacts the photoconductor.

Pressure may be applied to the shutter unit by the cover and thus the shutter unit may move in a first direction to apply pressure to the at least one developing unit, when the cover closes the side of the main body, and pressure applied to the shutter unit by the cover may be released and thus the shutter unit may move in a second direction opposite to the first direction to release pressure applied to the at least one developing unit, when the cover opens the side of the main body.

The image forming apparatus may include link units arranged between the shutter unit and the cover to operate the cover and the shutter unit in connection with each other, and the shutter unit may include at least one connection rod connected to the link unit so that pressure is applied to the shutter unit by the link unit.

Each of the link units may include a first link contacting cover and being slidable in the first direction and the second direction, and a second link contacting the first link and the at least one connection rod and being rotatable in a first rotation direction and a second rotation direction opposite to the first rotation direction.

The second link may include a first contact surface contacting the first link and a second contact surface contacting the at least one connection rod, and the first contact surface may be arranged at a position more distant from the center of rotation of the second link than the second contact surface.

Each of the link units may include a guide with which the first link and the at least one connection rod are slidably combined and with which the second link is rotatably combined.

The first link may include at least one first pressure protrusion to apply pressure to the second link, and the guide may include first guide slots accommodating the at least one first pressure protrusion and guiding movement of the at least one first pressure protrusion.

The at least one connection rod may include at least one second pressure protrusion to receive pressure transmitted from the second link, and the guide may include second guide slots accommodating the at least one second pressure protrusion and guiding movement of the at least one second pressure protrusion.

In accordance with an aspect of the present invention, an image forming apparatus includes a main body, a photoconductor arranged within the main body, a laser scanning unit irradiating light onto the photoconductor, at least one developing unit including a developing roller contacting the photoconductor to supply a developer to the photoconductor, and a shutter unit opening and closing the laser scanning unit, applying pressure to the at least one developing unit to execute contact between the developing roller and the photoconductor during a process of opening the laser scanning unit, and releasing pressure applied to the at least one developing unit to execute separation between the developing roller and the photoconductor during a process of closing the laser scanning unit.

The image forming apparatus may include a cover opening and closing a side of the main body, the shutter unit may be operated in connection with the cover, pressure may be applied to the shutter unit by the cover and thus the shutter unit may be arranged at a first position of opening the laser scanning unit when the cover closes the side of the main body, and pressure applied to the shutter unit by the cover may be released and thus the shutter unit may be arranged at a second position of closing the laser scanning unit when the cover opens the side of the main body.

The shutter unit may be movable between the first position and the second position, release pressure applied to the at least one developing unit to separate the developing roller and the photoconductor from each other when the shutter unit moves from the first position to the second position, and apply pressure to the at least one developing unit to bring the developing roller and the photoconductor into contact with each other when the shutter unit moves from the second position to the first position.

The shutter unit may include a body part moving between the first position and the second position, at least one opening formed through the body part and transmitting light irradiated from the laser scanning unit, and a plurality of pressure parts provided at both sides of the at least one opening, and each of the plurality of pressure parts may include a pressure member contacting the at least one developing unit to apply pressure to the at least one developing unit, an elastic member elastically supporting the pressure member, and an accommodating member accommodating the pressure member and the elastic member.

The accommodating member may include a support surface supporting an end of the elastic member.

The shutter unit may be arranged under the at least one developing unit.

In accordance with an aspect of the present invention, an image forming apparatus includes a main body, a cover opening and closing a side of the main body, at least one photoconductor unit arranged within the main body and including a photoconductor, a laser scanning unit irradiating light onto the photoconductor, at least one developing unit including a developing roller contacting the photoconductor to supply a developer to the photoconductor, and rotatably combined with the at least one photoconductor unit, and a shutter unit opening and closing the laser scanning unit, wherein the shutter unit is operated in connection with the cover, applies pressure to the at least one developing unit to execute contact between the developing roller and the photoconductor when the cover closes the side of the main body, and releases pressure applied to the at least one developing unit to execute separation between the developing roller and the photoconductor when the cover opens the side of the main body.

The shutter unit may include pressure parts to apply pressure to the at least one developing unit, and the developing roller and the pressure parts may be arranged at opposite positions based on the center of rotation of the at least one developing unit.

The image forming apparatus may include link units to operate the cover and the shutter unit in connection with each other, and each of the link units may include a first link being slidable by pressure applied by the cover, a second link being rotatable by pressure applied by the first link, and a guide supporting the first link and the second link.

The second link may contact an end of a shutter member and apply pressure to the shutter member to move the shutter member when the second link is rotated by pressure applied by the first link.

The first link may include first pressure protrusions contacting the second link and applying pressure to the second link to rotate the second link, and the shutter member may include second pressure protrusions contacting the second link and receiving pressure transmitted from the second link when the second link is rotated by pressure applied by the first pressure protrusions.

The second pressure protrusions may be arranged at a position closer to the center of rotation of the second link than the first pressure protrusions.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
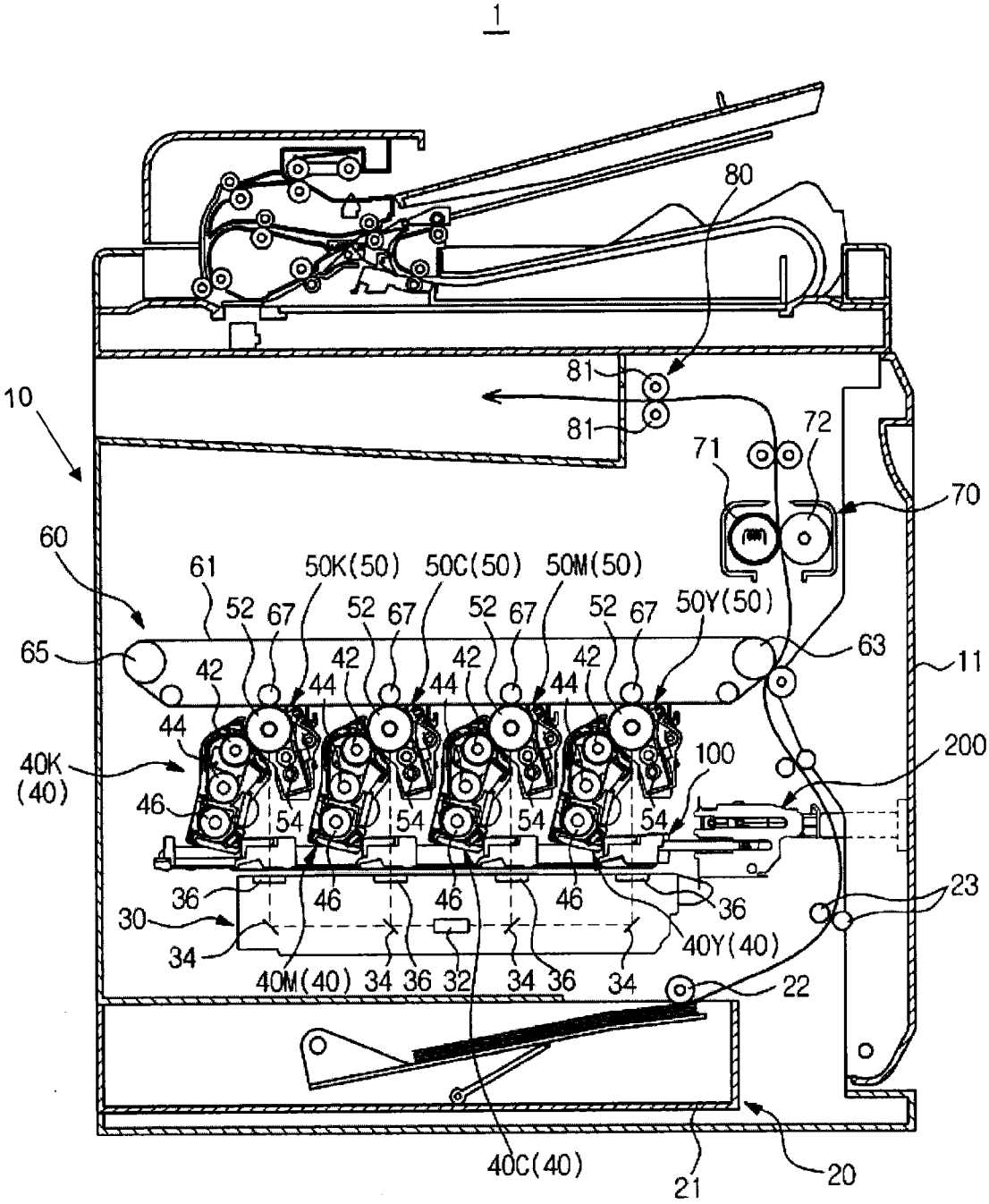
FIG. 1 illustrates an image forming apparatus in accordance with an embodiment of the present invention.

Reference will now be made in detail to the embodiments of the present invention, examples of which are illustrated in the accompanying drawings, wherein like reference numerals refer to like elements throughout.

FIG. 1 illustrates an image forming apparatus in accordance with an embodiment of the present invention.

As illustrated in FIG. 1, an image forming apparatus 1 includes a main body 10, a printing medium supply unit 20, a laser scanning unit 30, developing units 40, photoconductor units 50, a transfer unit 60, a fixing unit 70, and a printing medium exit unit 80.

The main body 10 forms the external appearance of the image forming apparatus 1, and supports various parts installed within the main body 10. A cover 11 may be rotatably installed at a side of the main body 10. The cover 11 opens and closes a portion of the main body 10. A user may open the cover 11 and approach the inside of the main body 10 to remove a jammed piece of paper from a printing path.

The printing medium supply unit 20 includes a cassette 21 in which printing media S may be stored, a pair of pick-up rollers 22 picking up the printing media S stored in the cassette 21 sheet by sheet, and feed rollers 23 feeding the picked-up printing medium to the transfer unit 60.

The laser scanning unit 30 may be arranged under the developing unit 40, and irradiates light corresponding to image information onto photoconductors 52 to form electrostatic latent images on the surfaces of the photoconductors 52. The laser scanning unit 30 includes a light source 32 generating light, a plurality of reflective mirrors 34 changing the path of the light generated from the light source 32, and a plurality of optical windows 36 transmitting light reflected by the plural reflective mirrors 34.

Each of developing units 40Y, 40M, 40C and 40K respectively accommodating developers of yellow (Y), magenta (M), cyan (C) and black (K) includes a developing roller 42 and supply rollers 44 and 46. The supply rollers 44 and 46 supply the developer to the developing roller 42, and the developing roller 42 adheres the developer to the surface of the photoconductor 52 on which the electrostatic latent image is formed and thus forms a visible image.

Each of photoconductor units 50Y, 50M, 50C and 50Y respectively corresponding to the developing units 40Y, 40M, 40C and 40Y includes a photoconductor 52 and a charger 54. The charger 54 charges the photoconductor 52 with a designated electric potential, and an electrostatic latent image is formed on the surface of the photoconductor 52 charged by the charger 54.

The transfer unit 60 includes a transfer belt 61 contacting the photoconductors 52 of the respective photoconductor units 50Y, 50M, 50C and 50K and endlessly moving, a driving roller 63 driving the transfer belt 61, a tension roller 65 providing designated tension to the transfer belt 61, and four rollers 67 to transfer visible images on the photoconductors 52 of the respective photoconductor units 50Y, 50M, 50C and 50K to a printing media.

The fixing unit 70 includes a heating roller 71 provided with a heat source, and a pressure roller 72 installed opposite the heating roller 71. When a printing medium passes through a gap between the heating roller 71 and the pressure roller 72, an image on the printing medium is fixed to the printing medium by heat transmitted from the heating roller 71 and pressure acting between the heating roller 71 and the pressure roller 72.

The printing medium exit unit 80 includes a plurality of exit rollers 81 to discharge the printing medium having passed through the fixing unit 70 to the outside of the main body 10.

The respective photoconductor units 50Y, 50M, 50C and 50K may be fixed to the inside of the main body 10, and the respective developing units 40Y, 40M, 40C and 40K may be configured so as to be mounted in the main body 10 or be separated from the main body 10 through a side of the main body 10. When the developing units 40Y, 40M, 40C and 40K are mounted in the main body 10, the respective developing units 40Y, 40M, 40C and 40K are combined with the respective photoconductor units 50Y, 50M, 50C and 50K so as to be rotatable about the centers of rotation CY, CM, CC and CK. The developing rollers 42 of the respective developing units 40Y, 40M, 40C and 40K contact the photoconductors 52 of the respective photoconductor units 50Y, 50M, 50C and 50K when the image forming apparatus 1 performs a printing operation, and are separated from the photoconductors 52 of the respective photoconductor units 50Y, 50M, 50C and 50K when the respective photoconductor units 50Y, 50M, 50C and 50K are separated from the main body 10 so as to be replaced. Elements to execute contact or separation between the developing rollers 42 and the photoconductors 52 are disclosed.

Figure 2:
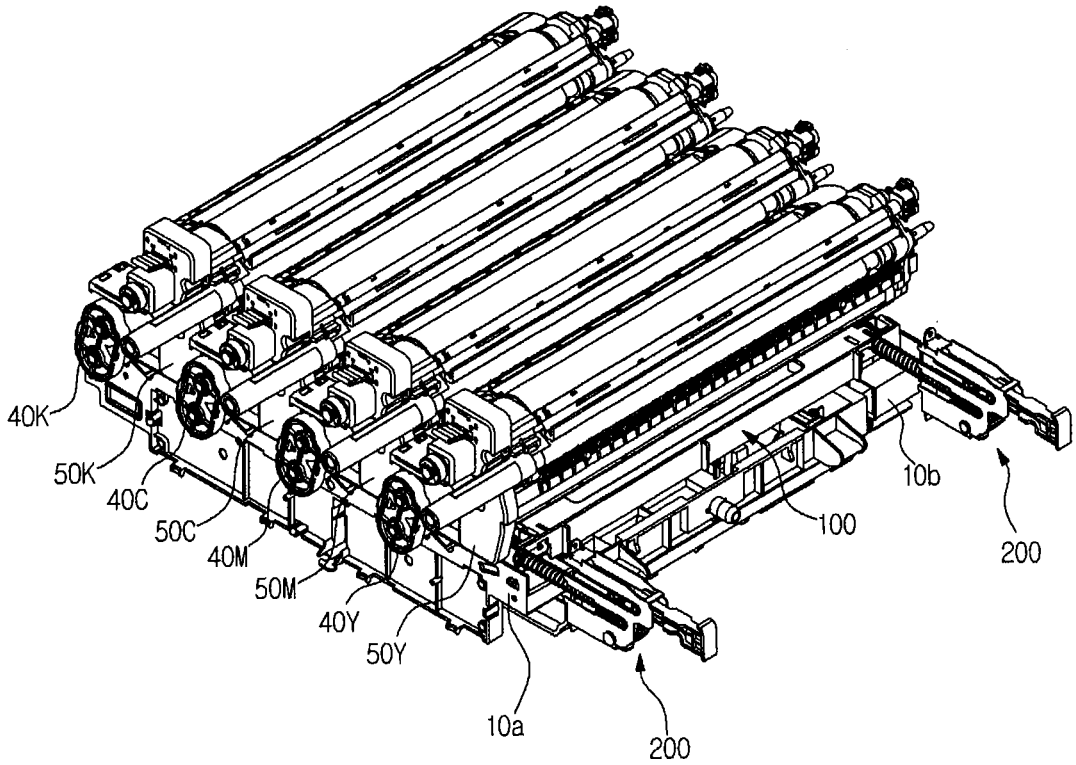
FIG. 2 illustrates exemplary elements to execute contact or separation between developing rollers and photoconductors.
Figure 3:
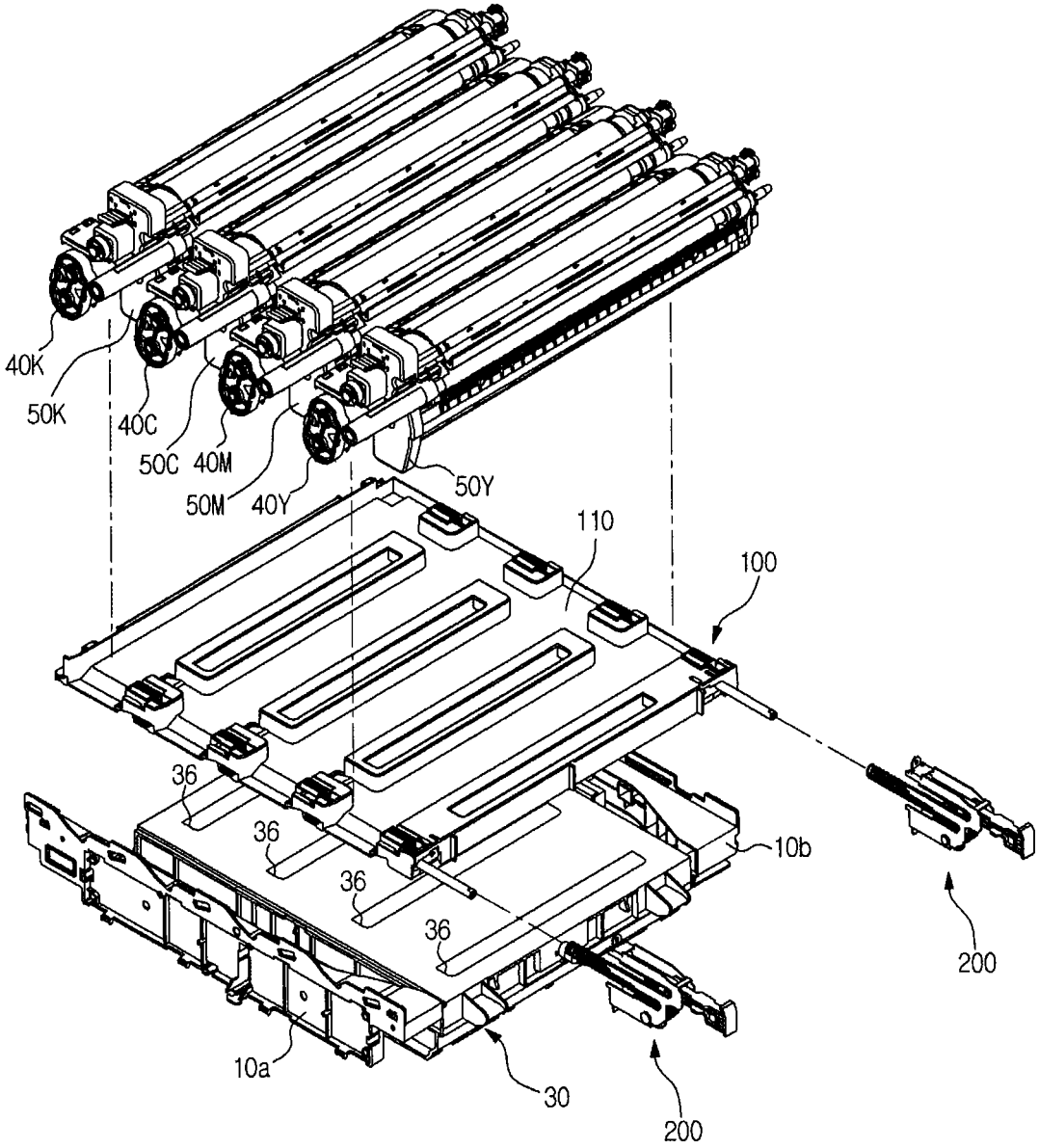
FIG. 3 is an exploded view illustrating exemplary elements of FIG. 2.
Figure 4:
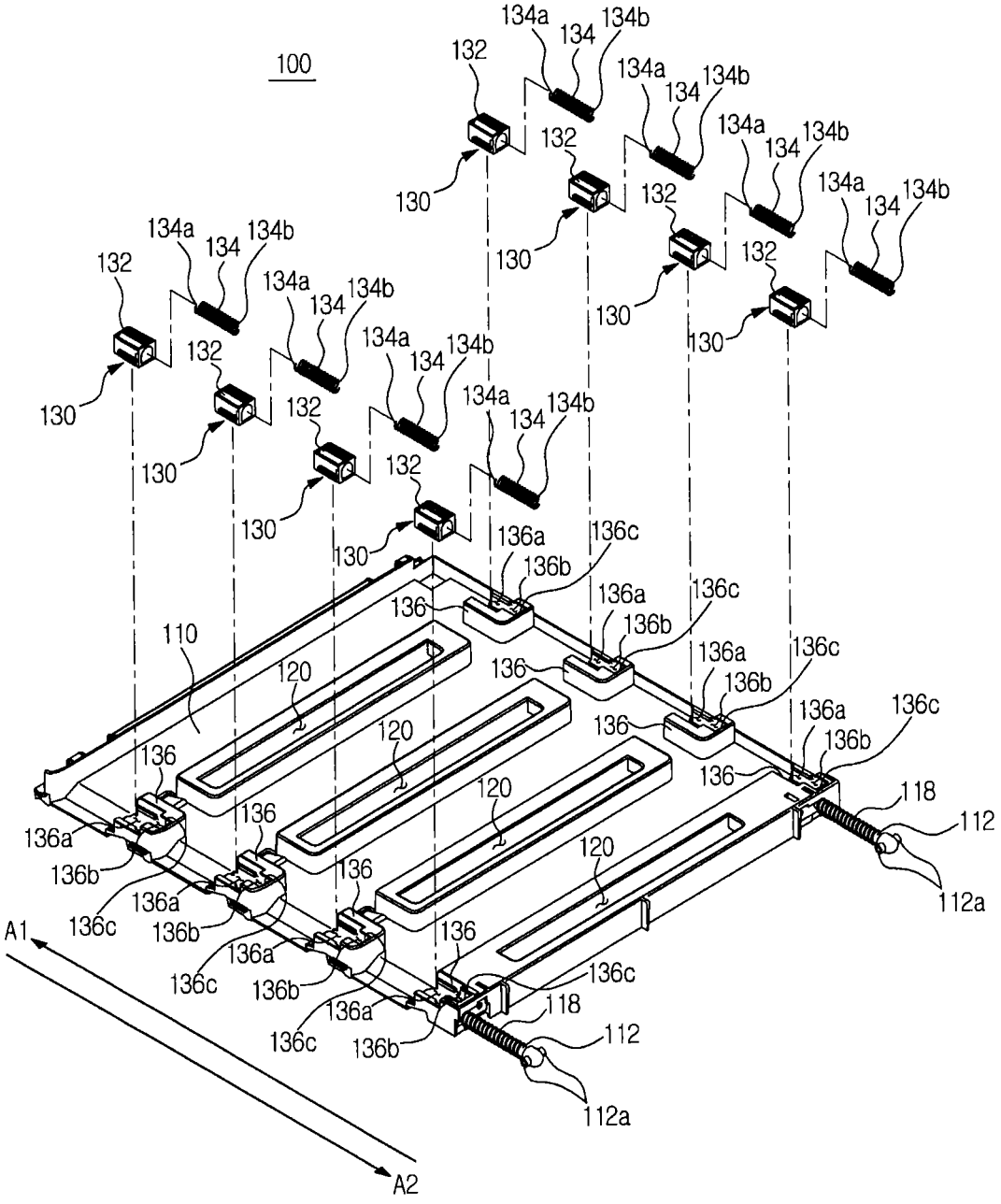
FIG. 4 illustrates an exemplary shutter unit.
Figure 5:
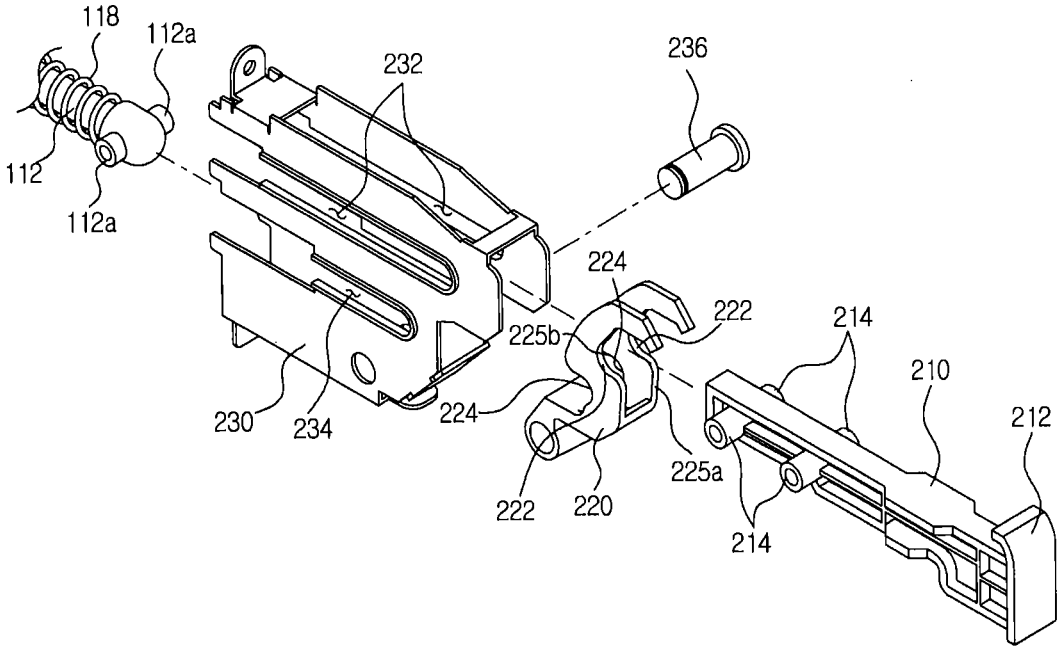
FIG. 5 illustrates an exemplary link unit.

FIG. 2 illustrates exemplary elements to execute contact and/or separation between the developing rollers and the photoconductors, FIG. 3 illustrates exemplary elements of FIG. 2, FIG. 4 illustrates an exemplary shutter unit, and FIG. 5 illustrates an exemplary link unit.

As illustrated in FIGS. 2 to 5, the developing rollers 42 and the photoconductors 52 may contact each other or are separated from each other by a shutter unit 100 operated in connection with the opening and closing operation of the cover 11, and link units 200 operating the cover 11 and the shutter unit 100 in connection with each other may be disposed between the cover 11 and the shutter unit 100.

As illustrated in FIG. 3, for example, shutter unit 100 includes a body part 110 that may be slidably arranged on the laser scanning unit 30 and under the plural developing units 40Y, 40M, 40C and 40K, a plurality of openings 120 formed through the body part 110 and arranged in the lengthwise direction, i.e., the moving direction of the body part 110, and a plurality of pressure parts 130 arranged at both sides of the body part 110 in the lengthwise direction, i.e., the moving direction of the body part 110, and connected to the body part 110.

The body part 110 may be slidably supported by support frames 10*a* and 10*b* provided at both sides of the inside of the main body 10, and move in a first direction Al (see, for example, FIG. 4) in connection with the cover 11 and may be arranged at a first position P1 to open and laser scanning unit 30 when the cover 11 closes the main body 10, and move in a second direction A2 opposite to the first direction A1 due to release of pressure applied by the cover 11 and may be arranged at a second position P2 to close the laser scanning unit 30 when the cover 11 opens the main body 10. The first direction A1 may be defined as a direction in which the cover 11 is directed to a side of the main body 10 opened and closed by the cover 11.

Connection rods 112 connected to the link units 200 so as to cause the body part 110 to slide in connection with the cover 11 may be provided at an end of the body part 110. The connection rods 112 may protrude from the end of the body part 110 in a direction toward the cover 11 to a designated length. The connection rod 112 includes at least one second pressure protrusion 112*a* contacting a second link 220 of the link unit 220 and receiving pressure transmitted from the second link 220. A first elastic member 118 may be provided between the at least one second pressure protrusion 112*a* and the end of the body part 110 provided with the connection rods 112, and allows the developing rollers 42 and the photoconductors 52 to smoothly contact each other without collision at force of more than a designated intensity when the respective developing units 40Y, 40M, 40C and 40K are rotated by pressure applied thereto during the sliding process of the body part 110.

The plural openings 120 may be provided on the body part 110 at positions corresponding to the plural optical windows 36 provided on the laser scanning unit 30 when the cover 11 closes the main body 10, and thus allow light having passed through the plural windows 36 to reach the photoconductors 52.

Each of the plural pressure parts 130 may include a pressure member 132 contacting each of the respective developing units 40Y, 40M, 40C and 40K and applying pressure to each of the developing units 40Y, 40M, 40C and 40K, a second elastic member 134 elastically supporting the pressure member 132, and an accommodating member 136 accommodating the pressure member 132 and the second elastic member 134.

The plural pressure members 132 may be arranged at positions where the pressure members 132 apply pressure to pressure surfaces 41 provided at the lower ends of the respective developing units 40Y, 40M, 40C and 40K when the respective developing units 40Y, 40M, 40C and 40K are mounted in the main body 10. The plural pressure members 132 and the pressure surfaces 41 may be arranged at positions opposite to the developing rollers 42 based on the centers of rotation CY, CM, CC and CK of the respective developing units 40Y, 40M, 40C and 40K.

The plural pressure members 132 move together with the body part 110, and apply pressure to the pressure surfaces 41 to rotate the respective developing units 40Y, 40M, 40C and 40K about the centers of rotation CY, CM, CC and CK, when the body part 110 is arranged at the first position P1 opening the laser scanning unit 30, thereby causing contact of the developing rollers 42 located above the centers of rotation CY, CM, CC and CK with the photoconductors 52.

Since an end 134*a* of the second elastic member 134 contacts the rear surface of the pressure member 132 and the other end 134*b* of the second elastic member 134 contacts a support surface 136*c* of the accommodating member 136, the second elastic member 134 elastically supports the pressure member 132. The second elastic members 134 allow the developing rollers 42 and the photoconductors 52 to smoothly contact each other without collision at force of more than a designated intensity when the pressure members 132 apply pressure to the respective developing units 40Y, 40M, 40C and 40K. Therefore, damage to the developing rollers 42 and/or the photoconductors 52 due, for example, to collision is prevented when pressure is applied to the developing units 40Y, 40M, 40C and 40K and thus the developing rollers 42 and the photoconductors 52 contact each other. The second elastic members 134 allow pressure of a designated intensity to be applied to the surfaces of the developing rollers 42 in a state in which the developing rollers 42 contact the photoconductors 52, thereby forming a designated developing gap between the developing rollers 42 and the photoconductors 52.

Each of the accommodating members 136 includes a first accommodating groove 136*a* accommodating the pressure member 132, a second accommodating groove 136*b* accommodating the second elastic member 134, and the support surface 136*c* provided on one surface of the second accommodating groove 136*b* and supporting the other end 134*b* of the second elastic member 134. The accommodating members 136 may be formed integrally with the body part 110 of the shutter unit 100.

The link units 200 may be arranged between the cover 11 and the shutter unit 100, and operate the cover 11 and the shutter unit 100 in connection with each other. Each of the link units 200 includes a first link 210 which is slidable, and a second link 220 which is rotatable, and a guide 230 movably supporting the first link 210 and the second link 220.

The first link 210 slides, for example, in a direction parallel with the moving direction of the shutter unit 10 when pressure is applied to the first link 210 by contact with the cover 11, and includes a contact surface 212 contacting the cover 11 and a first pressure protrusion 214 contacting the second link 220.

The contact surface 212 may be provided at an end of the first link 210 facing the inner surface of the cover 11, contacts the inner surface of the cover 11 when the cover 11 closes a side of the main body 10, and is separated from the inner surface of the cover 11 when the cover 11 opens the side of the main body 10.

The first pressure protrusions 214 protrude from both sides of the first link 210, are accommodated within first guide slots 232 provided on the guide 230, and guide sliding of the first pressure protrusions 214 and contact, for example, simultaneously, a first contact surface 222 of the second link 220 to apply pressure to the second link 220 to rotate the second link 220 when pressure is applied to the first pressure protrusions 214 by the cover 11 or is released.

The second link 220 is rotated in a first rotation direction R1 that is the same as the closing direction of the side of the main body 10 by the cover 11 when the second link 220 contacts the first link 210 and pressure is applied to the second link 220 by the first link 210. The second link 220 is rotated in a second rotation direction R2 that is opposite to the first rotation direction R1 and the same as the opening direction of the side of the main body 10 by the cover 11 when pressure applied to the second link 220 by the first link 210 is released. The second link 220 includes the first contact surface 222 contacting the first pressure protrusions 214 of the first link 210, and a second contact surface 224 contacting the second pressure protrusions 112*a* of the connection rod 112.

The first contact surface 222 may be formed in a shape accommodating the first pressure protrusions 214 on one surface 225*a* of the second link 220 contacting the first pressure protrusions 214 so that the first contact surface 222 may receive pressure applied by the first pressure protrusions 214 during the sliding process of the first link 210.

The second contact surface 224 may be formed in a shape accommodating the second pressure protrusions 112*a* on the other surface 225*b* of the second link 220 contacting the second pressure protrusions 112*a* so that the second link 220 may transmit pressure to the second pressure protrusions 112*a* during the rotating process of the second link 220.

The guide 230 includes the first guide slots 232 in which the first pressure protrusions 214 are accommodated, second guide slots 234 in which the second pressure protrusions 112*a* are accommodated, and a rotary shaft 236 supporting rotation of the second link 220.

The first guide slots 232 may be formed through both side surfaces of the guide 230, have a width corresponding to the diameter of the first pressure protrusions 214 so as to accommodate the first pressure protrusions 214, are extended in the same direction as the moving direction of the first link 210, and serve to guide sliding of the first pressure protrusions 214.

The second guide slots 234 may be formed through both side surfaces of the guide 230 at positions under the first guide slots 232, have a width corresponding to the diameter of the second pressure protrusions 112*a* so as to accommodate the second pressure protrusions 112*a*, are extended in the same direction as the moving direction of the connection rods 112 in parallel with the moving direction of the first link 210, and serve to guide sliding of the second pressure protrusions 112*a*.

The rotary shaft 236 may be combined with second link 220 and the guide 230, supports rotation of the second link 220, and serves as the center of rotation of the second link 220.

The first pressure protrusions 214 and the first contact surface 222 contacting the first pressure protrusions 214 may be arranged at a position that is more distant from the rotary shaft 236 than the second pressure protrusions 112*a* and the second contact surface 224 contacting the second pressure protrusions 112*a*. Such an arrangement reduces a force required for a user to close the cover 11 using the action of a double lever A doubling of force may be obtained due to a point where the first pressure protrusions 214 and the first contact surface 222 contact and a point where the second pressure protrusions 112*a* and the second contact surface 224 contact.

A contact or separation between the developing rollers 42 and the photoconductors 52 through connection of the cover 11, the shutter unit 100 and the link units 200 are disclosed.

Figure 6:
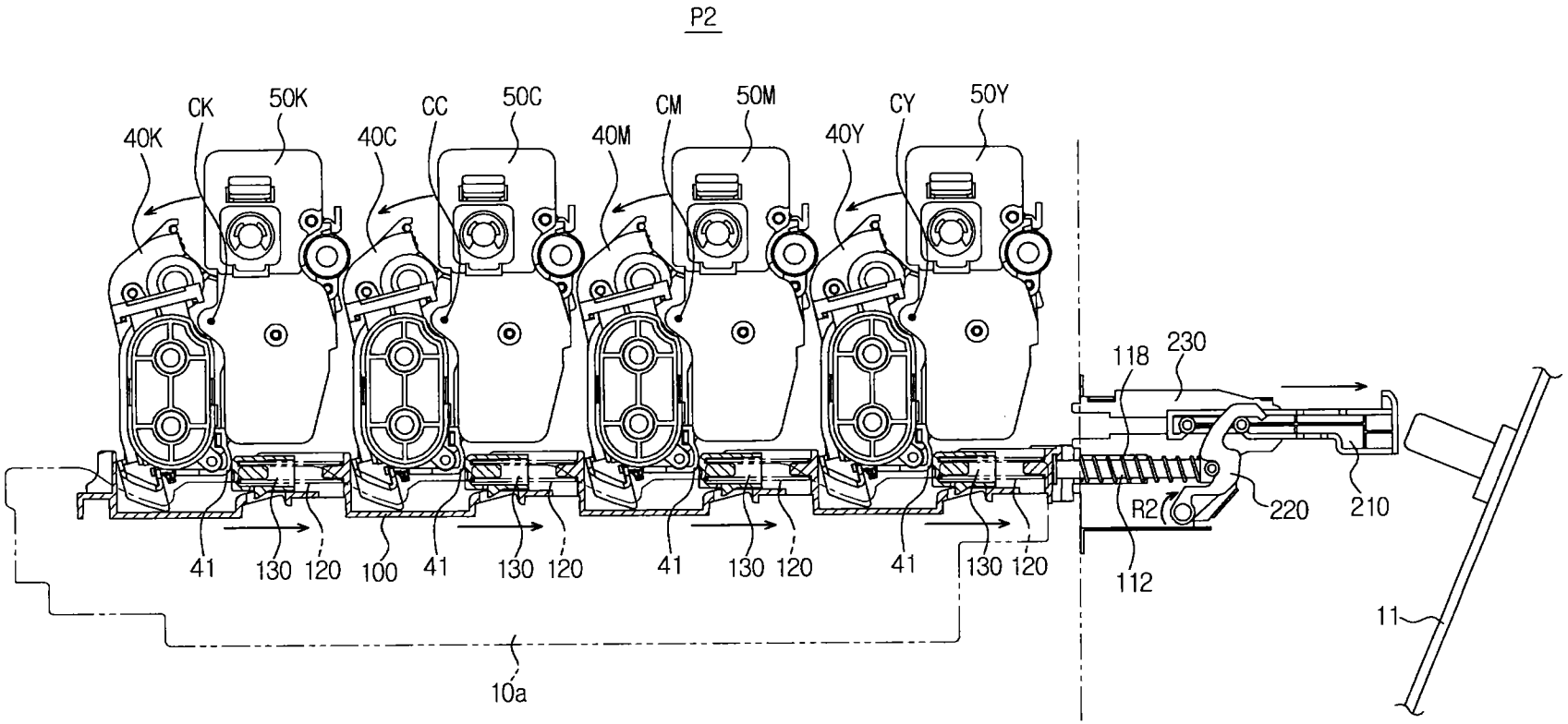
FIG. 6 illustrates an exemplary separation between developing rollers and photoconductors when the shutter unit is arranged at a second position.
Figure 7:
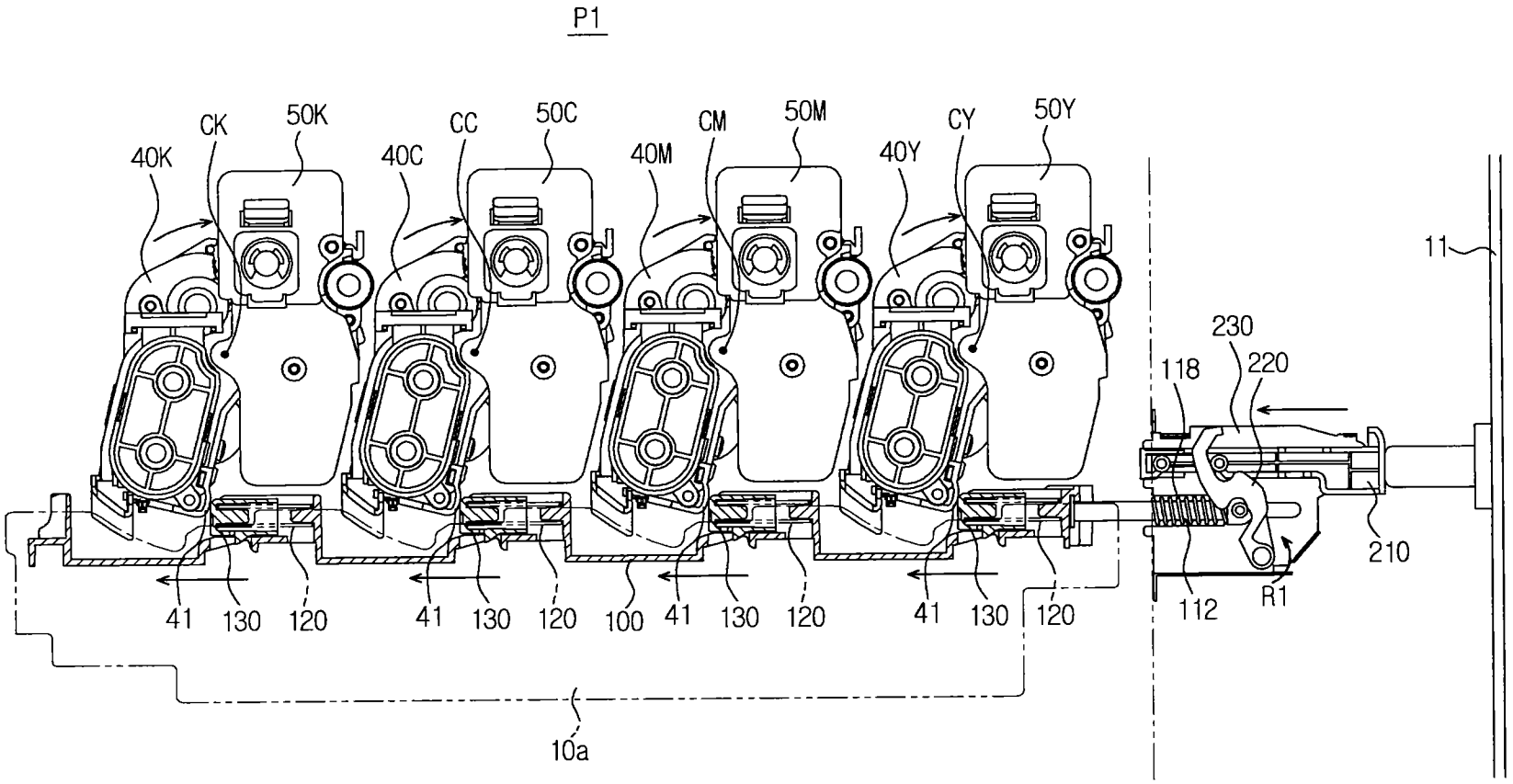
FIG. 7 illustrates an exemplary contact between the developing rollers and the photoconductors when the shutter unit is arranged at a first position.

FIG. 6 illustrates separation between the developing rollers and the photoconductors when the shutter unit is arranged at the second position, and FIG. 7 illustrates contact between the developing rollers and the photoconductors when the shutter unit is arranged at the first position. FIG. 6 illustrates a state in which the cover opens a side of the main body, and FIG. 7 illustrates a state in which the cover closes the side of the main body.

When the cover 11 opens a side of the main body 10, as illustrated in FIG. 6, the shutter unit 100 is arranged at the second position P2 to close the optical windows 36 of the laser scanning unit 30. In this arrangement, the cover 11 does not apply pressure to the link units 200, and the link units 20 do not apply pressure to the shutter unit 100.

When the cover 11 is rotated in a direction of closing the side of the main body 10, as illustrated in FIG. 7, pressure is applied to the first links 210 of the link units 200 by the cover 11 during the rotating process of the cover 11. Thus, the first links 210 slide in the direction toward the inside of the main body 10 and the second links 220 are rotated in the first rotation direction R1.

When the second links 220 are rotated, the second links apply pressure to the connection rods 112 contacting the second links. The body part 110 of the shutter unit 100 combined with the connection rods 112 slides in the first direction Al and opens the optical windows 36 of the laser scanning unit 30.

Simultaneously with opening of the optical windows 36 of the laser scanning unit 30, the plural pressure parts 130, which may be combined with the body part 110, move in the first direction Al together with the body part 110 and apply pressure to the pressure surfaces 41 of the respective developing units 40Y, 40M, 40C and 40K so that the respective developing units 40Y, 40M, 40C and 40K are rotated about the centers of rotation CY, CM, CC and CK. The developing rollers 42 gradually decrease in distance to the photoconductors 52 during the rotating process of the respective developing units 40Y, 40M, 40C and 40K.

When the cover 11 closes the side of the main body 10 by a designated amount or more, the sliding and rotation of the first links 210, the second links 220, the body part 110 and the pressure parts 130 may be considered complete. The body part 110 may be arranged at the first position P1 to open the laser scanning unit 30, and the developing rollers 42 contact the photoconductors 52 so as to maintain a constant gap therebetween.

In the state in which the cover 11 closes the side of the main body 10, as illustrated in FIG. 7, the shutter unit 100 may be arranged at the first position P1 to open the optical windows 36 of the laser scanning unit 30. In this arrangement, the cover applies pressure to the link units 200, and the link units 200 apply pressure to the shutter unit 100.

According to an exemplary embodiment, the cover 11 may be rotated in a direction of opening the side of the main body 10, as illustrated in FIG. 6. Pressure applied to the first links 210 of the link units 200 by the cover 11 is released during the rotating process of the cover 11. Thus, the first links 210 slide in the direction toward the side of the main body 10 opened by the cover 11. The second links 220 are rotated in the second rotation direction R2.

When the second links 220 are rotated, pressure applied to the connection rods 112 contacting the second links 220 by the second links 220 is released. The body part 110 of the shutter unit 100, combined with the connection rods 112, slides in the second direction A2 and closes the optical windows 36 of the laser scanning unit 30.

Simultaneously with closing of the optical windows 36 of the laser scanning unit 30, the plural pressure parts 130, which may be combined with the body part 110, move in the second direction A2 together with the body part 110 and release pressure applied to the respective developing units 40Y, 40M, 40C and 40K so that the respective developing units 40Y, 40M, 40C and 40K are rotated about the centers of rotation CY, CM, CC and CK. The developing rollers 42 gradually increase in distance from the photoconductors 52 during the rotating process of the respective developing units 40Y, 40M, 40C and 40K.

When the cover 11 opens the side of the main body 10 by a designated amount, or more, the sliding and rotation of the first links 210, the second links 220, the body part 110 and the pressure parts 130 are completed. The body part 110 may be arranged at the second position P2 to close the laser scanning unit 30, and the developing rollers 42 are separated from the photoconductors 52.

An image forming apparatus in accordance with an embodiment of the present invention may achieve contact or separation between developing rollers and photoconductors through a shutter unit operated in connection with the opening and closing operation of a cover, thus not requiring a separate component to execute contact or separation between the developing rollers and the photoconductor.

Since plural pressure parts may be mounted on the shutter unit to simultaneously execute application of pressure to plural developing units or release of pressure applied to the plural developing units, deviations that may be generated during a process of executing application of pressure to the plural developing units or release of pressure applied to the plural developing units are reduced.

Since application of pressure to the plural developing units or release of pressure applied to the plural developing units may be simultaneously executed through a simple action, for example, of opening and closing the cover, user convenience of the image forming apparatus is improved.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a main body;

a cover opening and closing a side of the main body;

at least one photoconductor unit arranged within the main body and including a photoconductor;

a laser scanning unit irradiating light onto the photoconductor to form an electrostatic latent image, and including a light source generating light and at least one optical window transmitting the light generated from the light source;

at least one developing unit supplying a developer to the photoconductor on which the electrostatic latent image is formed to form a visible image, and including a developing roller contacting or separated from the photoconductor; and a shutter unit operable in connection with the cover, opening the at least one optical window when the cover closes the side of the main body, and closing the at least one optical window when the cover opens the side of the main body, wherein the shutter unit applies pressure to the at least one developing unit to execute contact between the developing roller and the photoconductor during a process of opening the at least one optical window, and releases pressure applied to the at least one developing unit to execute separation between the developing roller and the photoconductor during a process of closing the at least one optical window.

2. The image forming apparatus according to claim 1, wherein:

the at least one developing unit is rotatably combined with the at least one photoconductor unit; and the shutter unit applies pressure to a side of the at least one developing unit to rotate the at least one developing unit, and thus executes contact between the developing roller and the photoconductor.

3. The image forming apparatus according to claim 2, wherein a pressure surface of the at least one developing unit to which pressure is applied by the shutter unit, and the developing roller are arranged at opposite positions based on the center of rotation of the at least one developing unit.

4. The image forming apparatus according to claim 1, wherein:

the shutter unit includes a body part provided with at least one opening transmitting light having passed through the at least one optical window, and a plurality of pressure parts combined with both sides of the body part; and each of the plurality of pressure parts includes a pressure member contacting the at least one developing unit to apply pressure to the at least one developing unit, and an elastic member elastically supporting the pressure member.

5. The image forming apparatus according to claim 4, wherein:

the at least one developing unit is rotatably combined with the at least one photoconductor unit; and the developing roller and the pressure member are arranged at positions above and below the center of rotation of the at least one developing unit.

6. The image forming apparatus according to claim 5, wherein the pressure member applies pressure to the lower end of the at least one developing unit to rotate the at least one developing unit when the cover closes the side of the main body, so that the developing roller arranged at the position above the center of rotation of the at least one developing unit contacts the photoconductor.

7. The image forming apparatus according to claim 1, wherein:

pressure is applied to the shutter unit by the cover and thus the shutter unit moves in a first direction to apply pressure to the at least one developing unit, when the cover closes the side of the main body; and pressure applied to the shutter unit by the cover is released and thus the shutter unit moves in a second direction opposite to the first direction to release pressure applied to the at least one developing unit, when the cover opens the side of the main body.

8. The image forming apparatus according to claim 7, further comprising link units arranged between the shutter unit and the cover to operate the cover and the shutter unit in connection with each other, wherein the shutter unit includes at least one connection rod connected to the link unit so that pressure is applied to the shutter unit by the link unit.

9. The image forming apparatus according to claim 8, wherein each of the link units includes:

a first link contacting cover and being slidable in the first direction and the second direction; and a second link contacting the first link and the at least one connection rod and being rotatable in a first rotation direction and a second rotation direction opposite to the first rotation direction.

10. The image forming apparatus according to claim 9, wherein:

the second link includes a first contact surface contacting the first link and a second contact surface contacting the at least one connection rod; and the first contact surface is arranged at a position more distant from the center of rotation of the second link than the second contact surface.

11. The image forming apparatus according to claim 9, wherein each of the link units further includes a guide with which the fist link and the at least one connection rod are slidably combined and with which the second link is rotatably combined.

12. The image forming apparatus according to claim 11, wherein:

the first link includes at least one first pressure protrusion to apply pressure to the second link; and the guide includes first guide slots accommodating the at least one first pressure protrusion and guiding movement of the at least one first pressure protrusion.

13. The image forming apparatus according to claim 11, wherein:

the at least one connection rod includes at least one second pressure protrusion to receive pressure transmitted from the second link; and the guide includes second guide slots accommodating the at least one second pressure protrusion and guiding movement of the at least one second pressure protrusion.

14. An image forming apparatus comprising:

a main body;

a photoconductor arranged within the main body;

a laser scanning unit irradiating light onto the photoconductor;

at least one developing unit including a developing roller contacting the photoconductor to supply a developer to the photoconductor; and a shutter unit opening and closing the laser scanning unit, applying pressure to the at least one developing unit to execute contact between the developing roller and the photoconductor during a process of opening the laser scanning unit, and releasing pressure applied to the at least one developing unit to execute separation between the developing roller and the photoconductor during a process of closing the laser scanning unit.

15. The image forming apparatus according to claim 14, further comprising a cover opening and closing a side of the main body, wherein the shutter unit is operable in connection with the cover, pressure is applied to the shutter unit by the cover and thus the shutter unit is arranged at a first position of opening the laser scanning unit when the cover closes the side of the main body, and pressure applied to the shutter unit by the cover is released and thus the shutter unit is arranged at a second position of closing the laser scanning unit when the cover opens the side of the main body.

16. The image forming apparatus according to claim 15, wherein:

the shutter unit is movable between the first position and the second position; and the shutter unit releases pressure applied to the at least one developing unit to separate the developing roller and the photoconductor from each other when the shutter unit moves from the first position to the second position, and applies pressure to the at least one developing unit to bring the developing roller and the photoconductor into contact with each other when the shutter unit moves from the second position to the first position.

17. The image forming apparatus according to claim 16, wherein the shutter unit includes:

a body part moving between the first position and the second position;

at least one opening formed through the body part and transmitting light irradiated from the laser scanning unit, and a plurality of pressure parts provided at both sides of the at least one opening, wherein each of the plurality of pressure parts includes a pressure member contacting the at least one developing unit to apply pressure to the at least one developing unit, an elastic member elastically supporting the pressure member, and an accommodating member accommodating the pressure member and the elastic member.

18. The image forming apparatus according to claim 17, wherein the accommodating member includes a support surface supporting an end of the elastic member.

19. The image forming apparatus according to claim 15, wherein the shutter unit is arranged under the at least one developing unit.

20. An image forming apparatus comprising:

a main body;

a cover opening and closing a side of the main body;

at least one photoconductor unit arranged within the main body and including a photoconductor;

a laser scanning unit irradiating light onto the photoconductor;

at least one developing unit including a developing roller contacting the photoconductor to supply a developer to the photoconductor, and rotatably combined with the at least one photoconductor unit; and a shutter unit opening and closing the laser scanning unit, wherein the shutter unit is operable in connection with the cover, applies pressure to the at least one developing unit to execute contact between the developing roller and the photoconductor when the cover closes the side of the main body, and releases pressure applied to the at least one developing unit to execute separation between the developing roller and the photoconductor when the cover opens the side of the main body.

21. The image forming apparatus according to claim 20, wherein the shutter unit includes pressure parts to apply pressure to the at least one developing unit, and the developing roller and the pressure parts are arranged at opposite positions based on the center of rotation of the at least one developing unit.

22. The image forming apparatus according to claim 21, further comprising link units to operate the cover and the shutter unit in connection with each other, wherein each of the link units includes:

a first link being slidable by pressure applied by the cover;

a second link being rotatable by pressure applied by the first link; and a guide supporting the first link and the second link.

23. The image forming apparatus according to claim 22, wherein the second link contacts an end of a shutter member, and applies pressure to the shutter member to move the shutter member when the second link is rotated by pressure applied by the first link.

24. The image forming apparatus according to claim 23, wherein:

the first link includes first pressure protrusions contacting the second link and applying pressure to the second link to rotate the second link; and the shutter member includes second pressure protrusions contacting the second link and receiving pressure transmitted from the second link when the second link is rotated by pressure applied by the first pressure protrusions.

25. The image forming apparatus according to claim 24, wherein the second pressure protrusions are arranged at a position closer to the center of rotation of the second link than the first pressure protrusions.

26. A shutter device for an image forming apparatus which includes a main body, a developing unit and a cover opening and closing a side of the main body, the shutter device comprising;

a shutter unit opening and closing a laser scanning unit of the image forming apparatus, wherein the shutter unit is operable in connection with the cover, applies pressure to a developing unit to execute contact between a developing roller and a photoconductor when the cover closes a side of the main body, and releases pressure applied to the developing unit to execute separation between the developing roller and the photoconductor when the cover opens the side of the main body.

27. A method of operating a shutter device of an image forming apparatus having a cover, and a developing unit including a developing roller contacting a photoconductor to supply a developer to the photoconductor, and rotatably combined with the photoconductor unit, the method comprising:

operating the shutter device in connection with the cover and applying pressure to the developing unit to execute a contact between the developing roller and the photoconductor when the cover closes a side of the main body, and releases pressure applied to the developing unit to execute a separation between the developing roller and the photoconductor when the cover opens the side of the main body.

* * * * *